US006755472B2

(12) United States Patent
Stenzel et al.

(10) Patent No.: US 6,755,472 B2
(45) Date of Patent: Jun. 29, 2004

(54) NECKREST FOR A CHAIR

(75) Inventors: Thomas Stenzel, Waldshut-Tiengen (DE); Michael Klaesener, Waldshut-Tiengen (DE)

(73) Assignee: Sedus Stoll AG, Waldshut-Tiengen (DE)

( * ) Notice: Subject to any disclaimer, the term of this patent is extended or adjusted under 35 U.S.C. 154(b) by 0 days.

(21) Appl. No.: 10/059,417

(22) Filed: Jan. 31, 2002

(65) Prior Publication Data

US 2003/0141751 A1 Jul. 31, 2003

(51) Int. Cl.[7] ..... A47C 1/10
(52) U.S. Cl. ..... 297/410; 297/408; 297/61
(58) Field of Search ..... 297/396, 405, 297/410, 440.24, 411.36, 353, 61, DIG. 2, 408; 248/161, 157, 286.1, 295.11, 118

(56) References Cited

U.S. PATENT DOCUMENTS

| | | | | | |
|---|---|---|---|---|---|
| 7,215 | A | * | 7/1850 | White | |
| 120,128 | A | * | 10/1871 | Thomspon | |
| 165,286 | A | * | 7/1875 | White | |
| 619,272 | A | * | 2/1899 | Browne | |
| 866,753 | A | * | 9/1907 | Weber | |
| 2,180,768 | A | * | 11/1939 | Peterson | |
| 4,047,758 | A | * | 9/1977 | Whitehill | |
| 4,191,423 | A | * | 3/1980 | Goldner | 297/408 |
| 4,256,341 | A | * | 3/1981 | Goldner et al. | 297/410 |
| 4,647,108 | A | * | 3/1987 | Hayashi | |
| 4,822,102 | A | * | 4/1989 | Duvenkamp | 297/403 |
| 4,848,838 | A | * | 7/1989 | McCrackin et al. | 297/391 |
| 5,011,225 | A | * | 4/1991 | Nemoto | 297/408 |
| 5,145,233 | A | * | 9/1992 | Nagashima | 297/408 |
| 6,056,364 | A | * | 5/2000 | De Filippo | |
| 6,074,010 | A | * | 6/2000 | Takeda | 297/391 |
| 6,199,947 | B1 | * | 3/2001 | Wiklund | 297/216.12 |

FOREIGN PATENT DOCUMENTS

| | | |
|---|---|---|
| CH | 535 141 | 1/1974 |
| DE | 2 115 220 | 10/1972 |

* cited by examiner

*Primary Examiner*—Peter M. Cuomo
*Assistant Examiner*—Stephen Vu
(74) *Attorney, Agent, or Firm*—Oblon, Spivak, McClelland, Maier & Neustadt, P.C.

(57) ABSTRACT

A neckrest, for a chair having a backrest, is configured to be attached to a backrest shield in a height-adjustable manner. The neckrest includes a circular cross-section retaining rod, configured to be connected to the backrest shield via an articulated or movable connection so as to be tiltable by up to approximately 30° in a vertical plane vertically with respect to a surface of the backrest, and a circular cross-section guide sleeve, mounted on the retaining rod so as to be slidingly shiftable by up to approximately 200 mm on the retaining rod. The retaining rod includes a molding on a side thereof which is closest the backrest and seated in a housing having a recess. The molding has a round surface which slides under pressure on a polyurethane rubber material friction dampening device so as to achieve the articulated connection.

4 Claims, 3 Drawing Sheets

NECKREST FOR A CHAIR

BACKGROUND OF THE INVENTION

1. Field of the Invention

The present invention generally relates to sitting furniture and more particularly, to a neckrest, for a chair having backrest, configured to be attached to a backrest shield in a height-adjustable manner, the neckrest including a circular cross-section retaining rod, configured to be connected to the backrest shield in an articulating or movable manner so as to be tiltable by up to approximately 30° in a vertical plane vertically with respect to a surface of the backrest, and a circular cross-section guide sleeve, mounted on the retaining rod so as to be slidingly shiftable by up to approximately 200 mm on the retaining rod.

2. Discussion of Background

It is known that the user of a chair, in particular an office chair or other type of work-related chair, often has the need for relaxation, which the user may accomplish by leaning back. According to the latest medical findings, optimal relaxation is achieved with an angle of opening between upper and lower body of about 25°. For this purpose, many chairs are equipped with a tiltable backrest.

One type of chair having a tiltable backrest is a so-called "high-back" chair. These "high-back" chairs often have the problem that the upper part of the backrest also supports the head or the neck, and this support of the head or the neck cannot be adjusted to the individual requirements of the user. Further, in the case of chairs with a low backrest, the headrest cannot be brought easily into the area of the head of the user.

SUMMARY OF THE INVENTION

It is therefore an object of the present invention to provide a neckrest for a chair having a backrest which is designed in such a way that the neckrest can be attached inconspicuously and aesthetically on the back shield of a chair with backrest, but that nevertheless the headrest covers the entire angular range, within which the user wants to rest his head against the pad. Furthermore, the neckrest of the present invention should be able to be manufactured in production with little effort and easily mountable on the chair having the backrest.

The above-stated objective is accomplished with by the neckrest of the present invention, wherein the neckrest is for a chair having a backrest, the neckrest configured to be attached to a backrest shield in a height-adjustable manner. The neckrest including a circular cross-section retaining rod, configured to be connected to the backrest shield in an articulating manner so as to be tiltable by up to 30° in a vertical plane vertically with respect to a surface of the backrest, and a circular cross-section guide sleeve, mounted on the retaining rod so as to be slidingly shiftable by up to 200 mm on the retaining rod.

In other words, the neckrest of the present invention includes connecting the headrest of the chair on a guide sleeve that slides on a retaining rod, fastening the retaining rod on the back shield through a simple joint in a tiltable manner, and designing the retaining rod and guide sleeve so as to have circular cross-sections. On the one hand, this allows the user to adjust the desired inclination of the neckrest in a simple manner. On the other hand, the height of the neckrest in also adjustable. It is very important that the retaining rod and the guide sleeve are designed so as to have circular cross-sections because, unlike a straight retaining rod, the circular cross-section retaining rod allows for an adjustment of the optimal distance of the headrest from the head of the user.

BRIEF DESCRIPTION OF THE DRAWING FIGURES

The present invention is explained in more detail in the following based on one example shown in the drawing figures, wherein.

DETAILED DESCRIPTION OF THE PREFERRED EMBODIMENTS

Figure 1:
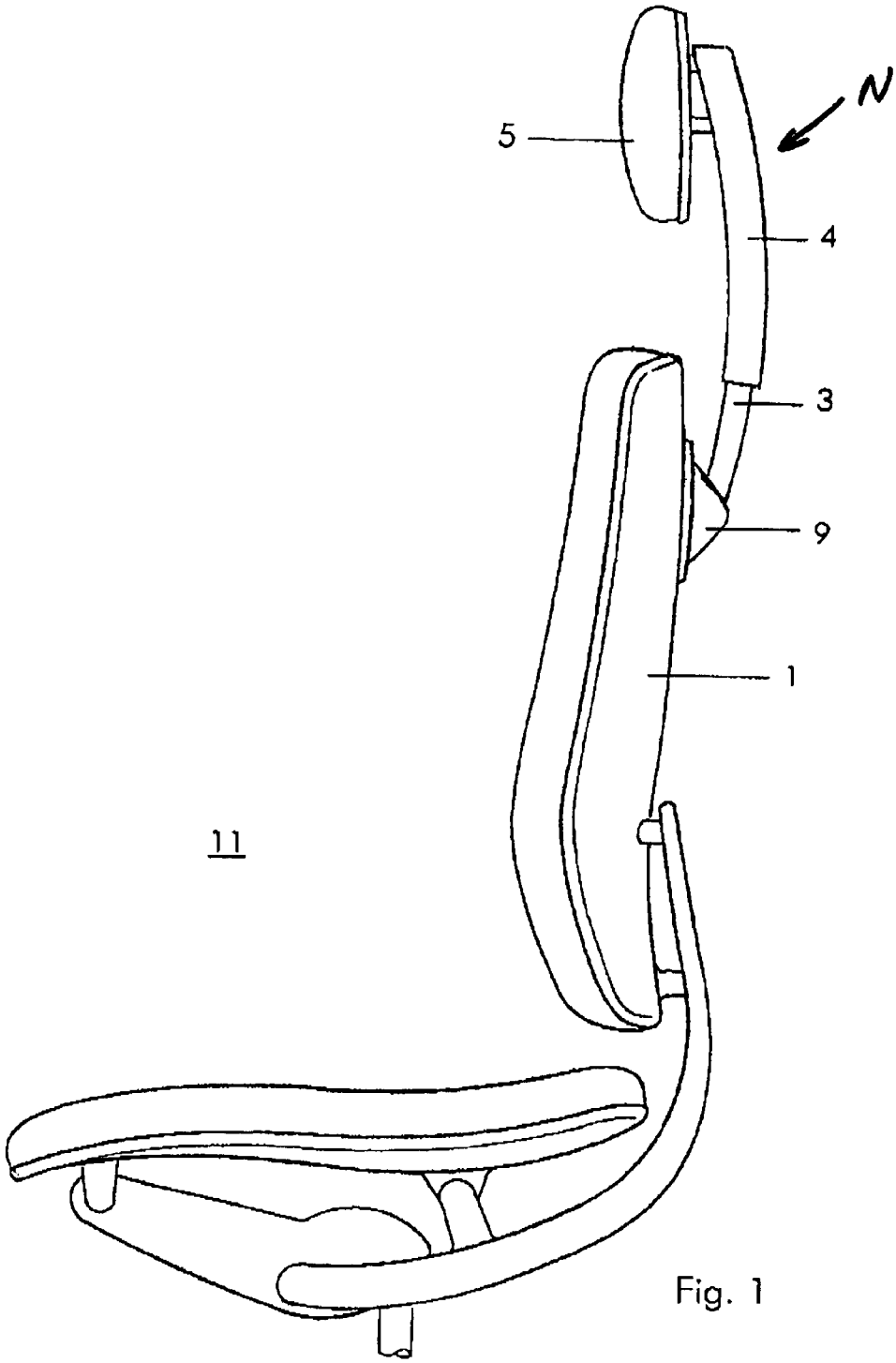
FIG. 1 is a side elevational view of a chair with a backrest having the attached neckrest of the present invention.

FIG. 1 depicts an office chair 11, which contains the familiar lower base, a seat, and a backrest. The neckrest N of the present invention includes a retaining rod 3, a guide sleeve 4, and a headrest 5 and is attached on the back of the backrest. The backrest and the seat can be tilted in the familiar fashion, wherein in the example shown in the figure, a synchronous mechanism is provided.

Figure 2:
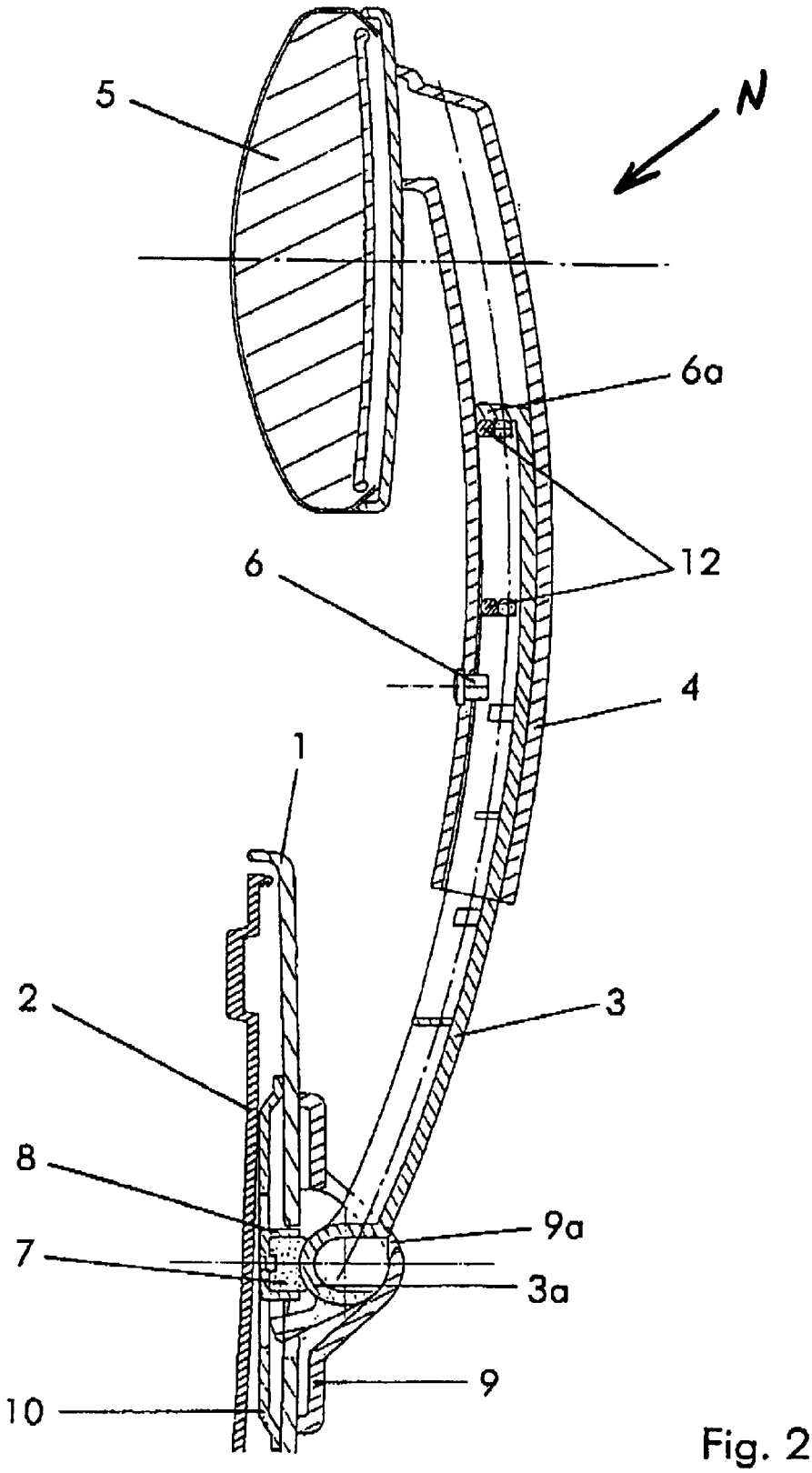
FIG. 2 is a cross-sectional view through the neckrest of the present invention with a headrest that is firmly attached to the guide sleeve.

FIG. 2 shows the neckrest N of the present invention in detail in a cross-sectional view. More particularly, the base plate 2 of the backrest pad is snapped on to the backrest shield 1. A housing 9 is provided over a portion of the back of the backrest shield 1. The housing 9 includes a recess 9*a*. The housing 9 is attached to the backrest shield 1 via the fastening plate 10. Fastening occurs using four screws (not shown), which penetrate the fastening plate 10 and the backrest shield 1 and which are screwed into screw domes (not shown) of the housing 9. In the housing 9, the retaining rod 3 is seated via a molding 3*a*. The molding 3*a* rests against the friction dampening device 7 when under pressure. The friction dampening device 7 preferably includes a polyurethane rubber or PUR material. The friction dampening device 7 is preferably held in the dampening sleeve 8. The dampening sleeve 8 is shaped from the fastening plate 10 in a combined cutting and bending process and the dampening sleeve 8 is preferably connected with the fastening plate 10.

The retaining rod 3 is designed so as to be circular in cross-section and curved along its length at a predetermined radius of curvature. The guide sleeve 4 is seated on the retaining rod 3 in a sliding manner, the guide sleeve 4 also being designed so as to be circular in cross-section and curved along its length with the same predetermined radius of curvature as the radius of curvature the circular cross-section, curved retaining rod 3. The headrest 5 is firmly attached on the end of the guide sleeve 4. The guide sleeve 4, and with it the headrest 5, can be height adjustable in a sliding manner on the retaining rod 2 by up to approximately 200 mm, but more preferably by approximately 150 mm and thus, as the guide sleeve 4 is slid up and down on the retaining rod 3, the headrest 5 is moving along a curved path according to the radius of curvatures of the retaining rod 3 and the guide sleeve 4. On one hand, the roller bearing elements 12, which consist of a polyurethane rubber or PUR material, cause the guide sleeve 4 to be moved easily. On the other hand, the roller bearing elements 12 remain fixed in the position adjusted by the user.

In order to ensure that the guide sleeve 4 cannot be pulled off the retaining rod 3, a stop screw 6 is provided in the guide sleeve 4, with the stop screw 6 limiting the path of the guide sleeve 4 due to the stop on the lug 6*a* of the retaining rod 3.

Figure 3:
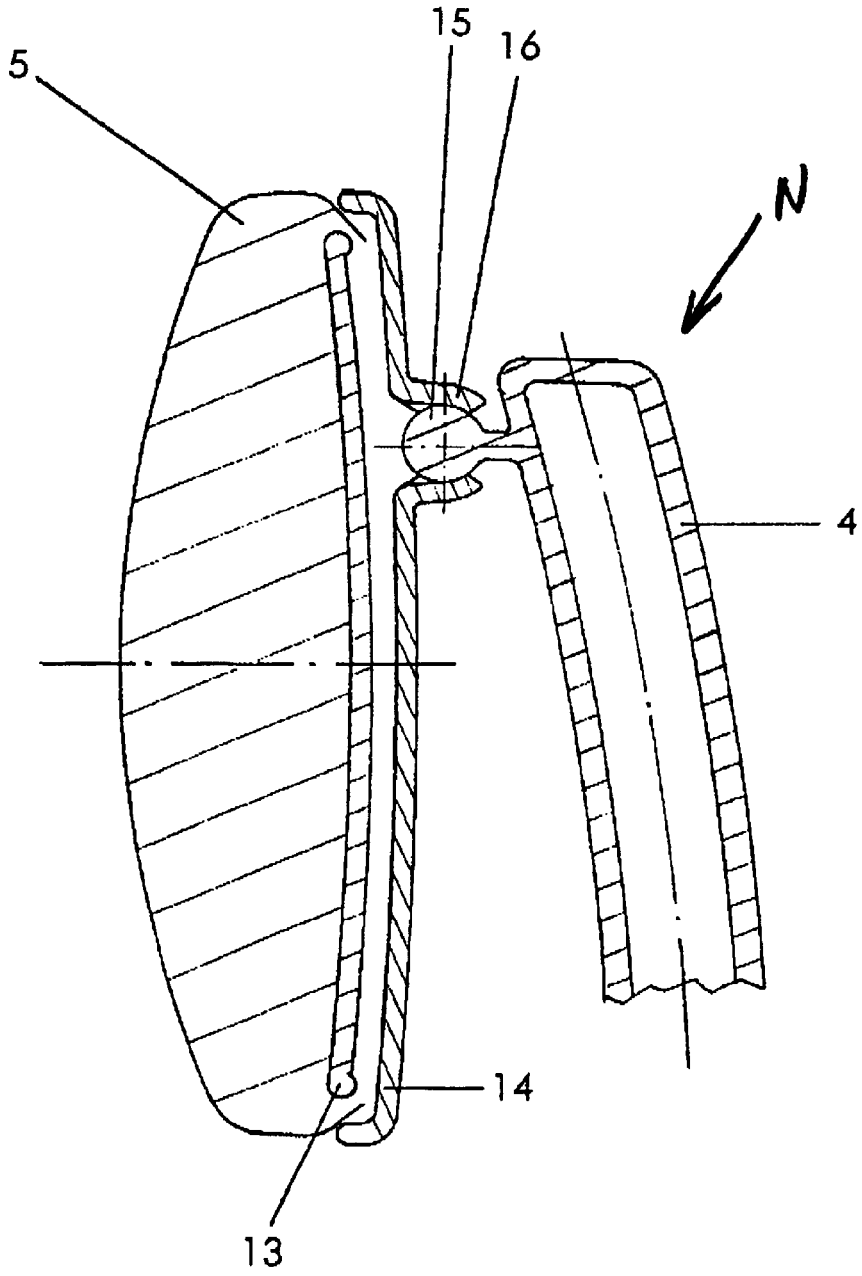
FIG. 3 is a cross-sectional view through the upper part of the neckrest of the present invention with a headrest that is attached to the guide sleeve in an articulating manner.

FIG. 3 shows the neckrest N of the present invention as shown in FIG. 2, However, the neckrest N shown in FIG. 3 has the head-rest 5 connected to the guide sleeve 4 via a joint including a rolling element 15 and a fastening device 16.

More particularly, FIG. 3 illustrates the headrest shield 14 having a plate 13 and the head-rest 5 snapped thereon. The guide sleeve 4 contains a rolling element 15, which is seated in a fastening device 16 shaped from the head-rest shield 14. The rolling element 15 can be designed as a ball or circular cylinder. As can be seen, with this articulating connection the user can adjust the head-rest 5 in a cardanic manner (in the case of the ball) or in a sagital manner (in the case of the circular cylinder) in accordance with his needs to any suitable position.

The present invention makes it possible to attach a neckrest, which is tiltable and height adjustable, to the backrest of a chair having a backrest in a simple, yet aesthetically pleasing manner, and to enable the user to adjust the neckrest to any ergonomically desirable position. Further, the production effort for the neckrest of the present invention is modest and assembly is easy.

List of Reference Characters

1 Backrest Shield
2 Pad Plate
3 Retaining Rod
3*a* Molding
4 Guide Sleeve
5 Headrest
6 Stop Screw
6*a* Stop Lug
7 Friction Dampening Device
8 Dampening Sleeve
9 Housing
9*a* Recess
10 Fastening Plate
11 Chair
12 Roller Bearing Element
13 Headrest Plate
14 Headrest Shield
15 Rolling Element
16 Fastening Device
N Neckrest

What is claimed as new and desired to be secured by Letters Patent of the United States is:

1. A neckrest for a chair having a backrest, the neckrest adapted to be attached to a backrest shield of the backrest of the chair in a height-adjustable manner, the neckrest comprising:

a retaining rod being circular in cross-section and adapted to be connected to the backrest shield via a movable connection so as to be tiltable by up to approximately 30° in a vertical plane vertically with respect to a backrest surface of the backrest; and a guide sleeve being circular in cross-section and being mounted on the retaining rod so as to be slidingly shiftable by up to approximately 200 mm on the retaining rod, wherein the guide sleeve includes roller bearing elements and a stop pin, the roller bearing elements aiding a sliding movement of the guide sleeve on the retaining rod, and the stop pin limiting a travel path of the guide sleeve on the retaining rod due to a stop on a stop lug of the retaining rod.

2. A neckrest for a chair having a backrest, the neckrest adapted to be attached to a backrest shield of the backrest of the chair in a height-adjustable manner, a neckrest comprising:

a retaining rod being curved along a length thereof at a predetermined radius of curvature and adapted to be connected to the backrest shield via a movable connection so as to be tiltable by up to approximately 30° in a vertical plane vertically with respect to a backrest surface of the backrest;

a guide sleeve curved along a length thereof at a same predetermined radius of curvature as the retaining rod and being mounted on the retaining rod so as to be slidingly shiftable by up to approximately 200 mm on the retaining rod; and a headrest connected to the guide sleeve, wherein when the guide sleeve is slidingly shifted on the retaining rod, the headrest moves along a curved path according to the predetermined radius of curvatures of the retaining rod and the guide sleeve.

3. A neckrest for a chair having a backrest, the neckrest adapted to be attached to a backrest shield of the backrest of the chair in a height-adjustable manner, the neckrest comprising:

a retaining rod being circular in cross-section and adapted to be connected to the backrest shield via a movable connection so as to be tiltable by up to approximately 30° in a vertical plane vertically with respect to a backrest surface of the backrest; and a guide sleeve being circular in cross-section and being mounted on the retaining rod so as to be slidingly shiftable by up to approximately 200 mm on the retaining rod, wherein the retaining rod includes a molding provided on a side of the retaining rod which is closest the backrest, the molding being seated in a housing having a recess, and the molding having a round surface which slides under pressure on a friction dampening device so as to achieve the movable connection.

4. The neckrest of claim 3, wherein the friction dampening device is made of a polyurethane rubber (PUR) material.

* * * * *